US011316263B2

(12) United States Patent
Daojian et al.

(10) Patent No.: US 11,316,263 B2
(45) **Date of Patent: *Apr. 26, 2022**

(54) RADIATION APPARATUS

(71) Applicant: Huawei Technologies Co., Ltd., Shenzhen (CN)

(72) Inventors: Dingjiu Daojian, Dongguan (CN); Weihong Xiao, Dongguan (CN); Guoqing Xie, Dongguan (CN); Xiaogang Xue, Xi'an (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 2 days.

This patent is subject to a terminal disclaimer.

(21) Appl. No.: 16/916,840

(22) Filed: Jun. 30, 2020

(65) Prior Publication Data

US 2020/0395657 A1 Dec. 17, 2020

Related U.S. Application Data

(63) Continuation of application No. 16/531,976, filed on Aug. 5, 2019, now Pat. No. 10,714,820, which is a (Continued)

(51) Int. Cl.
*H01Q 1/36* (2006.01)
*H01Q 19/10* (2006.01)

(Continued)

(52) U.S. Cl.
CPC ..... *H01Q 1/36* (2013.01); *H01Q 1/246* (2013.01); *H01Q 9/26* (2013.01); *H01Q 19/10* (2013.01);

(Continued)

(58) Field of Classification Search
CPC ..... H01Q 19/10; H01Q 19/108; H01Q 1/24; H01Q 1/246; H01Q 1/36; H01Q 21/00;

(Continued)

(56) References Cited

U.S. PATENT DOCUMENTS 2,618,746 A * 11/1952 Pauch ..... H01Q 9/265 343/742
4,180,820 A * 12/1979 Johns ..... H01Q 21/26 343/797

(Continued)

FOREIGN PATENT DOCUMENTS

CN 1886864 A 12/2006
CN 101707291 A 5/2010

(Continued)

OTHER PUBLICATIONS

CN/201580024669.7, Notice of Allowance, dated Oct. 31, 2019.
U.S. Appl. No. 15/858,993, filed Dec. 29, 2017.

(Continued)

*Primary Examiner* — Tho G Phan
(74) *Attorney, Agent, or Firm* — Leydig, Voit & Mayer, Ltd.

(57) ABSTRACT

The present application discloses a radiation apparatus, the apparatus comprises at least four radiators, two L-shaped feeding sheets, and a balun structure, the balun structure consists of four L-shaped structures formed by eight conductive plates; and each L-shaped structure is formed by two conductive plates arranged at approximately 90 degrees, each L-shaped structure is electrically connected to one radiator at one end of the balun structure, and angles between a length direction of the radiator and two conductive plates are approximately 45 degrees; every two adjacent L-shaped structures are arranged in a T shape, and the four radiators are approximately in a cross shape and are approximately in a same horizontal plane; two adjacent conductive plates of every two L-shaped structures are approximately parallel to each other and are spaced by a preset distance to form four feeding slots.

20 Claims, 6 Drawing Sheets

Related U.S. Application Data continuation of application No. 15/858,993, filed on Dec. 29, 2017, now Pat. No. 10,389,018, which is a continuation of application No. PCT/CN2015/082826, filed on Jun. 30, 2015.

(51) Int. Cl.

| | |
|---|---|
| ***H01Q 21/26*** | (2006.01) |
| ***H01Q 1/24*** | (2006.01) |
| ***H01Q 9/26*** | (2006.01) |
| ***H01Q 21/00*** | (2006.01) |
| ***H01Q 21/24*** | (2006.01) |
| ***H01Q 21/28*** | (2006.01) |

(52) U.S. Cl.
CPC ..... *H01Q 19/108* (2013.01); *H01Q 21/0006* (2013.01); *H01Q 21/24* (2013.01); *H01Q 21/26* (2013.01); *H01Q 21/28* (2013.01)

(58) Field of Classification Search
CPC .... H01Q 21/0006; H01Q 21/24; H01Q 21/26; H01Q 21/28; H01Q 9/26; H01Q 9/28
See application file for complete search history.

(56) References Cited

U.S. PATENT DOCUMENTS

| | | | | |
|---|---|---|---|---|
| 4,242,685 | A * | 12/1980 | Sanford | H01Q 13/106 343/700 MS |
| 6,034,649 | A | 3/2000 | Wilson et al. | |
| 6,072,439 | A | 6/2000 | Ippolito et al. | |
| 6,163,306 | A | 12/2000 | Nakamura et al. | |
| 7,053,852 | B2 | 5/2006 | Timofeev et al. | |
| 8,199,063 | B2 | 6/2012 | Moon et al. | |
| 9,276,323 | B2 | 3/2016 | Moon et al. | |
| 9,276,329 | B2 | 3/2016 | Jones et al. | |
| 10,205,226 | B2 * | 2/2019 | Li | H01Q 19/10 |
| 10,530,068 | B2 * | 1/2020 | Mirmozafari | H01Q 5/48 |
| 10,714,820 | B2 * | 7/2020 | Daojian | H01Q 19/108 |
| 2011/0291905 | A1 | 12/2011 | Liu | |
| 2013/0307743 | A1 | 11/2013 | Moon et al. | |
| 2016/0134023 | A1 | 5/2016 | Liu et al. | |

FOREIGN PATENT DOCUMENTS

| | | | |
|---|---|---|---|
| CN | 101834345 | A | 9/2010 |
| CN | 201584503 | U | 9/2010 |
| CN | 201845867 | U | 5/2011 |
| CN | 102403569 | A | 4/2012 |
| CN | 102694237 | A | 9/2012 |
| CN | 202474193 | U | 10/2012 |
| CN | 103339798 | A | 10/2013 |
| CN | 203339309 | U | 12/2013 |
| CN | 103531890 | A | 1/2014 |
| CN | 103715519 | A | 4/2014 |
| CN | 104319480 | A | 1/2015 |
| FR | 2863110 | A1 | 6/2005 |
| GB | 2517735 | A | 3/2015 |
| JP | 2014504127 | A | 2/2014 |
| KR | 20140018620 | A | 2/2014 |
| WO | 2011092311 | A2 | 8/2011 |

OTHER PUBLICATIONS

U.S. Appl. No. 16/531,976, filed Aug. 5, 2019.
U.S. Appl. No. 15/858,993, filed Dec. 29, 2017.

* cited by examiner

RADIATION APPARATUS

CROSS-REFERENCE TO RELATED APPLICATIONS

This application is a continuation of U.S. patent application Ser. No. 16/531,976, filed on Aug. 5, 2019, which is a continuation of U.S. patent application Ser. No. 15/858,993, filed on Dec. 29, 2017 (now U.S. Pat. No. 10,389,018), which is a continuation of International Patent Application No. PCT/CN2015/082826, filed on Jun. 30, 2015. All of the afore-mentioned patent applications are hereby incorporated by reference in their entireties.

TECHNICAL FIELD

The present application relates to the communications field, and in particular, to a radiation apparatus.

BACKGROUND

As an important part of a wireless communications system, an antenna is a system component for radiating and receiving electromagnetic waves. Performance of the antenna decides performance of a mobile communications system. A high-performance antenna meets a requirement of a broadband system and improves performance of the entire system. A core problem of design of a modern antenna is to enable the antenna to meet more rigorous technical requirements in a new system, and surpass an original antenna form to meet new system requirements. With a rapid growth in a quantity of mobile users, the communications system is continuously updated and expanded. To reduce interference between antennas and to lower costs, the antenna is required to work within a broadband range, and meet requirements of communication between multiple systems at the same time, thereby achieving sharing of one antenna in multiple systems and sharing of one antenna in receiving and sending. A research in a base station antenna shared by multiple systems can reduce a quantity of antennas so as to reduce interference between the antennas and lower costs, and an original base station can be shared. Therefore, the research in a multi-band base station antenna unit is of great significance.

A base station antenna mostly uses a linear polarization manner. A monopole antenna mostly uses vertical linear polarization. A dual-polarized antenna generally includes two manners: vertical and horizontal polarization and +/−45-degree polarization. Generally, the latter has better performance than the former. Therefore, the manner of +/−45-degree polarization is used in most cases currently. Because one dual-polarized antenna consists of two mutually orthogonal polarized antennas packed in a same radome, use of the dual-polarized antenna can dramatically reduce a quantity of antennas, simplify antenna engineering and installation, lower costs, and reduce space occupied by an antenna, and is a mainstream of current antenna deployment in urban areas. The dual-polarized antenna combines two antennas whose polarization directions: a +45-degree direction and a −45-degree direction are mutually orthogonal, and the two antennas simultaneously work in receiving and sending duplex mode. In addition, because polarization is performed in the +45-degree direction and the −45-degree direction that are orthogonal, it can be ensured that a degree of isolation between the +45-degree antenna and the −45-degree antenna meets a requirement of intermodulation on a degree of isolation between antennas (>30 dB), so that spacing between dual-polarized antennas needs to be only 20 to 30 cm, and a good effect of diversity reception can be effectively ensured.

For conventional +/−45-degree polarized antennas, no relationship exists between radiation arms that correspond to a +45-degree polarization and a −45-degree polarization. When a radiation arm that corresponds to one polarization works, a radiation arm that corresponds to the other polarization does not work. When the conventional +/−45-degree polarized antennas are used to construct a plane array, a location and a feeding manner of a low-frequency unit cause significant impact on an adjacent high-frequency unit.

SUMMARY

In view of this, embodiments of the present application provide a radiation apparatus, which can achieve a +/−45-degree polarization effect, thereby reducing coupling between a high-frequency unit and a low-frequency unit in a multi-frequency multi-array environment.

A first aspect provides a radiation apparatus, including at least four radiators, two L-shaped feeding sheets, and a balun structure, where the balun structure consists of four L-shaped structures formed by eight conductive plates; each L-shaped structure is formed by two conductive plates arranged at approximately 90 degrees, each L-shaped structure is electrically connected to one radiator at one end of the balun structure, and angles between a length direction of the radiator and two conductive plates are approximately 45 degrees; every two adjacent L-shaped structures are arranged in a T shape, and the four radiators are approximately in a cross shape and are approximately in a same horizontal plane; two adjacent conductive plates of every two L-shaped structures are approximately parallel to each other and are spaced by a preset distance to form four feeding slots; and the two L-shaped feeding sheets are disposed at approximately 90 degrees in the feeding slots in a staggered manner, and each L-shaped feeding sheet is disposed in two opposite feeding slots.

With reference to an implementation manner of the first aspect, in a first possible implementation manner, a total length of each radiator is approximately one quarter of a wavelength corresponding to an operating frequency band.

With reference to the first aspect or the first possible implementation manner of the first aspect, in a second possible implementation manner, a total length of each conductive plate is approximately one quarter of the wavelength corresponding to the operating frequency band.

With reference to the first aspect or the first possible or the second possible implementation manner of the first aspect, in a third possible implementation manner, each L-shaped structure is in direct electrical connection or in electrical coupling connection with one radiator.

With reference to the third possible implementation manner of the first aspect, in a fourth possible implementation manner, one end of the radiator has a coupling structure that is in electrical coupling connection with the L-shaped structure.

With reference to the first aspect or the first possible, the second possible, or the third possible implementation manner of the first aspect, in a fifth possible implementation manner, in the L-shaped structure, connecting sides of the two conductive plates are completely connected to form an integral structure.

With reference to the fifth possible implementation manner of the first aspect, in a sixth possible implementation manner, at one end of each L-shaped structure, the radiator is connected to a joint of the two conductive plates.

With reference to the first aspect or the first possible, the second possible, or the third possible implementation manner, in a seventh possible implementation manner, in the L-shaped structure, connecting sides of the two conductive plates are partially connected, and partially form a groove.

With reference to the seventh possible implementation manner of the first aspect, in an eighth possible implementation manner, the groove is formed at one end of the L-shaped structure that is close to the radiator, or formed in a middle part of the L-shaped structure.

With reference to the first aspect or the first possible, the second possible, the third possible, the fourth possible, the fifth possible, the sixth possible, the seventh possible, or the eighth possible implementation manner of the first aspect, in a ninth possible implementation manner, a length direction of the radiator is at 90 degrees or slightly tilted with respect to a length direction of the balun structure.

With reference to the first aspect or the first possible, the second possible, the third possible, the fourth possible, the fifth possible, the sixth possible, the seventh possible, the eighth possible, or the ninth possible implementation manner of the first aspect, in a tenth possible implementation manner, at one end of each L-shaped structure, a transverse rod is connected to two sides of the two conductive plates that are away from each other to form an approximately isosceles triangle, and one end of the radiator is welded to a middle part of the transverse rod.

With reference to the first aspect or the first possible, the second possible, the third possible, the fourth possible, the fifth possible, the sixth possible, the seventh possible, the eighth possible, or the ninth possible implementation manner of the first aspect, in an eleventh possible implementation manner, at one end of each L-shaped structure, one end of a first connecting rod and one end of a second connecting rod are respectively connected to the two conductive plates, the other end of the first connecting rod and the other end of the second connecting rod are connected, one end of the radiator is connected to a joint of the first connecting rod and the second connecting rod, and connecting sides of the two conductive plates and the length direction of the radiator are in a same plane.

With reference to the first aspect or the first possible, the second possible, the third possible, the fourth possible, the fifth possible, the sixth possible, the seventh possible, the eighth possible, the ninth possible, the tenth possible, or the eleventh possible implementation manner of the first aspect, in a twelfth possible implementation manner, the L-shaped feeding sheet includes a first connecting portion, a second connecting portion, and a third connecting portion, where the third connecting portion is parallel to the first connecting portion and has a length less than that of the first connecting portion, the second connecting portion is perpendicularly connected to the first connecting portion and the third connecting portion, and the first connecting portion and the third connecting portion are respectively disposed in two opposite feeding slots.

With reference to the twelfth possible implementation manner of the first aspect, in a thirteenth possible implementation manner, one end of the first connecting portion of the L-shaped feeding sheet that is away from the second connecting portion is directly inserted into a PCB, and the conductive plate is connected to a ground of the PCB.

With reference to the thirteenth possible implementation manner, in a fourteenth possible implementation manner, the end of the first connecting portion of the L-shaped feeding sheet that is away from the second connecting portion forms a coaxial suspended stripline structure together with the balun structure, where a metal housing of the coaxial suspended stripline structure is connected to the balun structure, and an internal suspended stripline is connected to the end of the first connecting portion of the L-shaped feeding sheet that is away from the second connecting portion.

A radiation apparatus provided in the present application includes at least four radiators, two L-shaped feeding sheets, and a balun structure, where the balun structure consists of four L-shaped structures formed by eight conductive plates; each L-shaped structure is formed by two conductive plates arranged at approximately 90 degrees, each L-shaped structure is electrically connected to one radiator at one end of the balun structure, and angles between a length direction of the radiator and two conductive plates are approximately 45 degrees; every two adjacent L-shaped structures are arranged in a T shape, and the four radiators are approximately in a cross shape and are approximately in a same horizontal plane; two adjacent conductive plates of every two L-shaped structures are approximately parallel to each other and are spaced by a preset distance to form four feeding slots; and the two L-shaped feeding sheets are disposed at approximately 90 degrees in the feeding slots in a staggered manner, and each L-shaped feeding sheet is disposed in two opposite feeding slots, so that when one L-shaped feeding sheet is polarized, the four radiators all participate in radiation. By using vector combination, required working polarization is obtained in a +/−45-degree direction, thereby achieving a +/−45-degree polarization effect, and reducing coupling between a high-frequency unit and a low-frequency unit in a multi-frequency multi-array environment.

BRIEF DESCRIPTION OF DRAWINGS

To describe the technical solutions in the embodiments of the present application more clearly, the following briefly describes the accompanying drawings required for describing the embodiments or the prior art. Apparently, the accompanying drawings in the following description show some embodiments of the present application, and a person of ordinary skill in the art may still derive other drawings from these accompanying drawings without creative efforts.

DESCRIPTION OF EMBODIMENTS

To make the objectives, technical solutions, and advantages of the embodiments of the present application clearer, the following clearly describes the technical solutions in the embodiments of the present application with reference to the accompanying drawings in the embodiments of the present application. Apparently, the described embodiments are some but not all of the embodiments of the present application. All other embodiments obtained by a person of ordinary skill in the art based on the embodiments of the present application without creative efforts shall fall within the protection scope of the present application.

Figure 1:
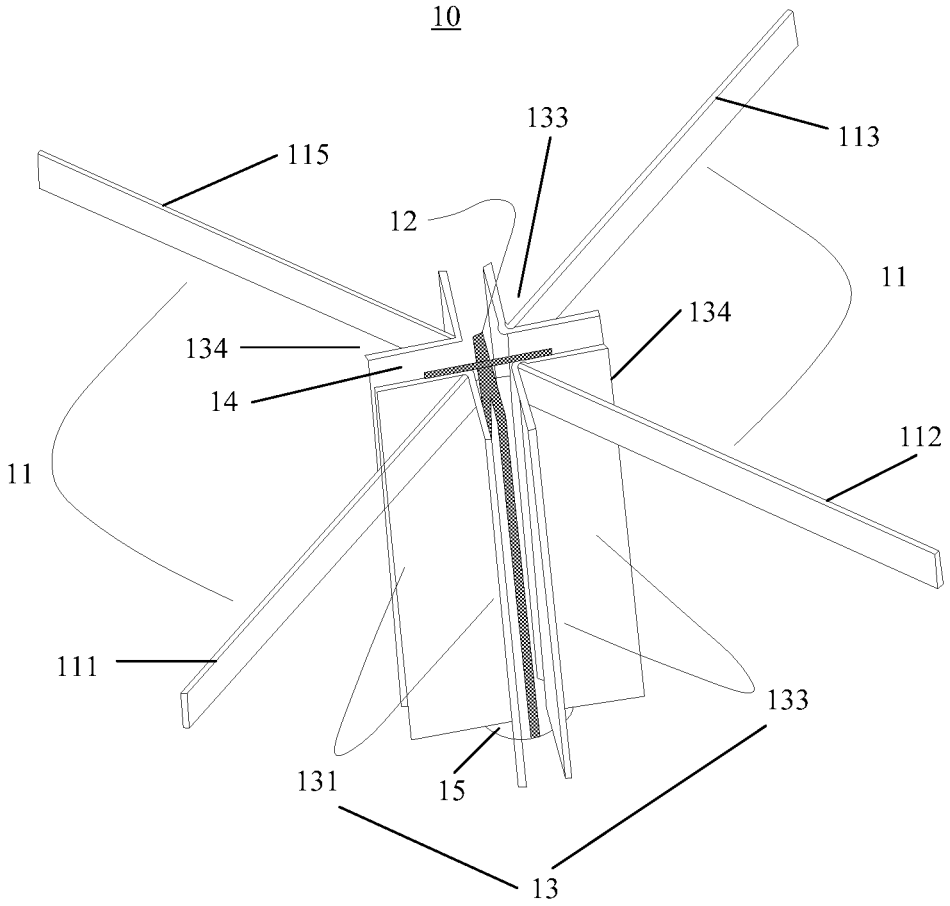
FIG. 1 is a schematic structural diagram of a radiation apparatus according to a first embodiment of the present application.

Referring to FIG. 1, FIG. 1 is a schematic structural diagram of a radiation apparatus according to a first embodiment of the present application. As shown in FIG. 1, a radiation apparatus 10 includes at least four radiators 11, two L-shaped feeding sheets 12, and a balun structure 13, where the balun structure 13 consists of four L-shaped structures 131 formed by eight conductive plates 132. Each L-shaped structure 131 is formed by two conductive plates 132 arranged at approximately 90 degrees, each L-shaped structure 131 is electrically connected to one radiator 11 at one end of the balun structure 13, and angles between a length direction of the radiator 11 and two conductive plates 132 are approximately 45 degrees; every two adjacent L-shaped structures 131 are arranged in a T shape, and the four radiators 11 are approximately in a cross shape and are approximately in a same horizontal plane; two adjacent conductive plates 132 of every two L-shaped structures 131 are approximately parallel to each other and are spaced by a preset distance to form four feeding slots 14; and the two L-shaped feeding sheets 12 are disposed at approximately 90 degrees in the feeding slots 14 in a staggered manner, and each L-shaped feeding sheet 12 is disposed in two opposite feeding slots 14.

In a more specific embodiment, a total length of each radiator 11 is approximately one quarter of a wavelength corresponding to an operating frequency band. The radiator 11 may be of a cuboid shape, or may be of a cylinder shape, which is not specifically limited. A total length of each conductive plate 132 is approximately one quarter of the wavelength corresponding to the operating frequency band. At the other end of the balun structure 13, the eight conductive plates 132 may be connected by using a connecting structure 15, or may be separated from each other. A shape of the connecting structure 15 is not limited, and may be a disc shape, a cylinder shape, a square shape, or the like.

Figure 2:
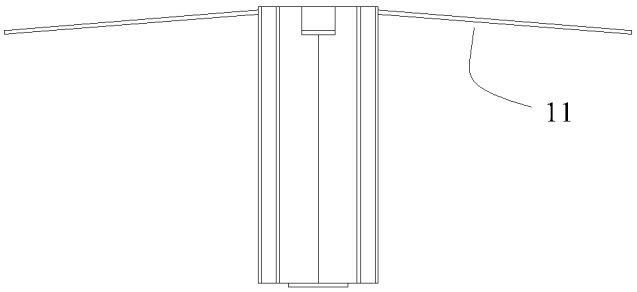
FIG. 2 is a side view of the radiation apparatus in FIG. 1.

In an L-shaped structure, two conductive plates may be connected directly, or may be not connected directly and only disposed in an L shape. Referring to FIG. 1, in the L-shaped structure 131, connecting sides of two conductive plates 132 may be completely connected to form an integral structure. At one end of each L-shaped structure 131, the radiator 11 is connected to a joint of the two conductive plates 132. For a side view of the radiation apparatus 10 in FIG. 1, refer to FIG. 2. For example, if the radiator 11 is of a cuboid shape, the radiator 11 is welded at the joint of the two conductive plates 132 and a width direction of the radiator 11 is parallel to length directions of the two conductive plates 132.

In this embodiment of the present application, a length direction of the radiator is at 90 degrees with respect to a length direction of the balun structure, or a length direction of the radiator is slightly tilted with respect to a length direction of the balun structure, but a tilt angle should not be excessively large. It can be known from FIG. 2 that the length direction of the radiator is slightly tilted with respect to the length direction of the balun structure.

Figure 3:
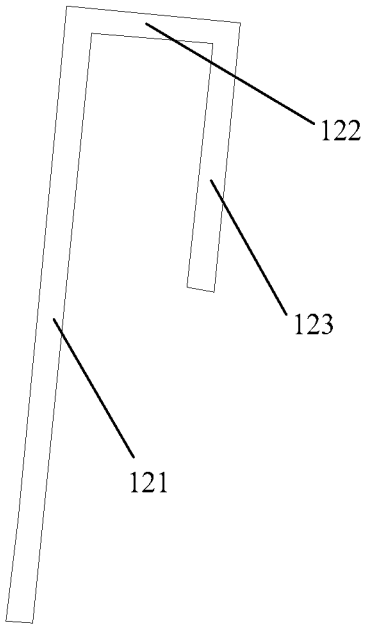
FIG. 3 is a schematic structural diagram of an L-shaped feeding sheet according to an embodiment of the present application.

As shown in FIG. 3, the L-shaped feeding sheet 12 includes a first connecting portion 121, a second connecting portion 122, and a third connecting portion 123, where the third connecting portion 123 is parallel to the first connecting portion 121 and has a length less than that of the first connecting portion 121, the second connecting portion 122 is perpendicularly connected to the first connecting portion 121 and the third connecting portion 123, and the first connecting portion 121 and the third connecting portion 123 are respectively disposed in two opposite feeding slots 14. The length of the first connecting portion 121 is approximately one quarter of the wavelength corresponding to the operating frequency band, and the length of the third connecting portion 123 is not greater than that of the first connecting portion 121. Therefore, a total length of the L-shaped feeding sheet 12 is not greater than one half of the wavelength corresponding to the operating frequency band.

Figure 4:
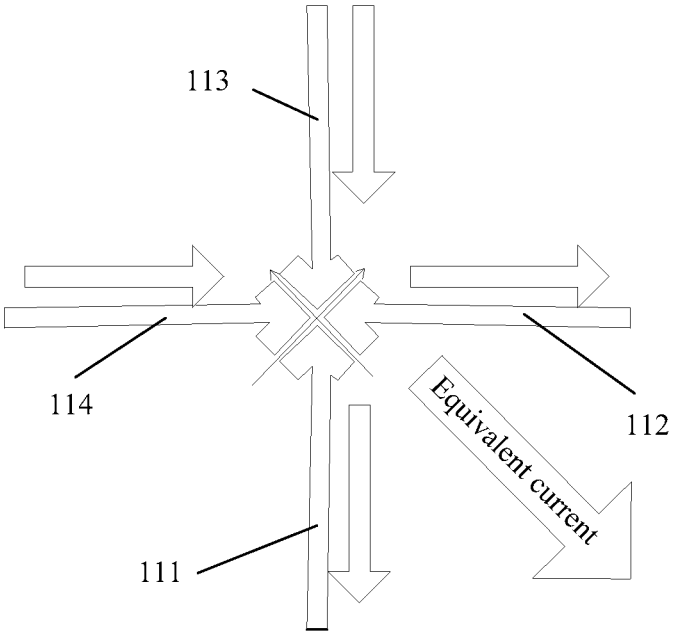
FIG. 4 is a schematic vector diagram of a working current of the radiation apparatus in FIG. 1.

When the radiation apparatus 10 works, the two L-shaped feeding sheets function at the same time. The following gives a description by using an example in which an L-shaped feeding sheet 12 located in a +45-degree polarization direction is powered on and works: A direction of downward is selected for a current of the first connecting portion 121 of the L-shaped feeding sheet 12, that is, flowing to one end away from the radiator, and correspondingly, a direction of a current of the third connecting portion 123 is upward, that is, flowing to one end towards the radiator. Currents generated in the four radiators are shown in FIG. 4, where flow directions of currents in a horizontal direction are just consistent with those in a vertical direction. Specifically, referring to FIG. 1 and FIG. 4, directions of currents of a first L-shaped structure 131 and a second L-shaped structure 133 are reverse to the direction of the current of the first connecting portion 121, and are upward; and correspondingly, directions of currents of a first radiator 111 and a second radiator 112 are outward. Directions of currents of a third L-shaped structure 134 and a fourth L-shaped structure 135 are reverse to the direction of the current of the third connecting portion 123, and are upward; and correspondingly, directions of currents of a third radiator 113 and a fourth radiator 114 are inward. It can be seen that when an L-shaped feeding sheet in a polarization direction works, the four radiators all participate in radiation. Flow directions of currents of two radiators that are horizontally disposed are consistent, flow directions of currents of two radiators that are vertically disposed are consistent, and working polarization in a +45-degree direction is obtained by using vector combination. When two L-shaped feeding sheets function at the same time, required working polarization may be obtained in a +/−45-degree direction by using vector combination, thereby achieving a +/−45-degree polarization effect, and reducing coupling between a high-frequency unit and a low-frequency unit in a multi-frequency multi-array environment.

Figure 5:
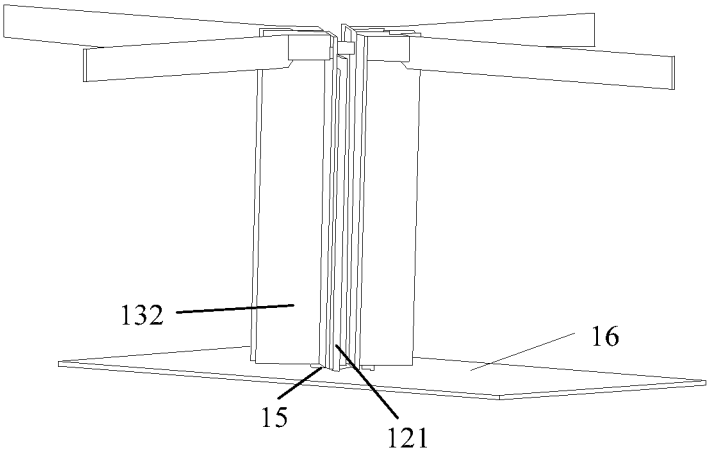
FIG. 5 is a schematic structural diagram of a radiation apparatus according to a second embodiment of the present application.
Figure 6:
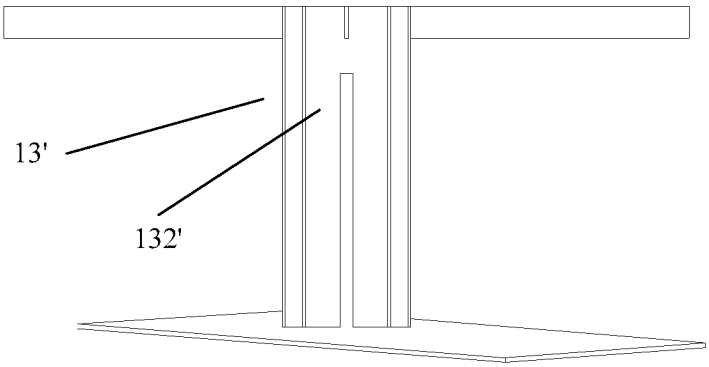
FIG. 6 is a schematic structural diagram of a radiation apparatus according to a third embodiment of the present application.

As shown in FIG. 5, one end of the first connecting portion 121 of the L-shaped feeding sheet 12 that is away from the second connecting portion 122 is directly inserted in a PCB 16, and the conductive plate 132 is connected to a ground of the PCB 16. A reflection plate (not shown in the figure) is disposed below the PCB 16. The eight conductive plates 132 that form the balun structure 13 may be directly electrically connected first at the other end of the balun structure 13 by using the connecting structure 15, and then connected to the reflection plate. Alternatively, referring to FIG. 6, eight conductive plates 132' that form a balun structure 13' are in coupling connection by using the reflection plate, that is, the eight conductive plates 132' are connected to the reflection plate separately.

Figure 7:
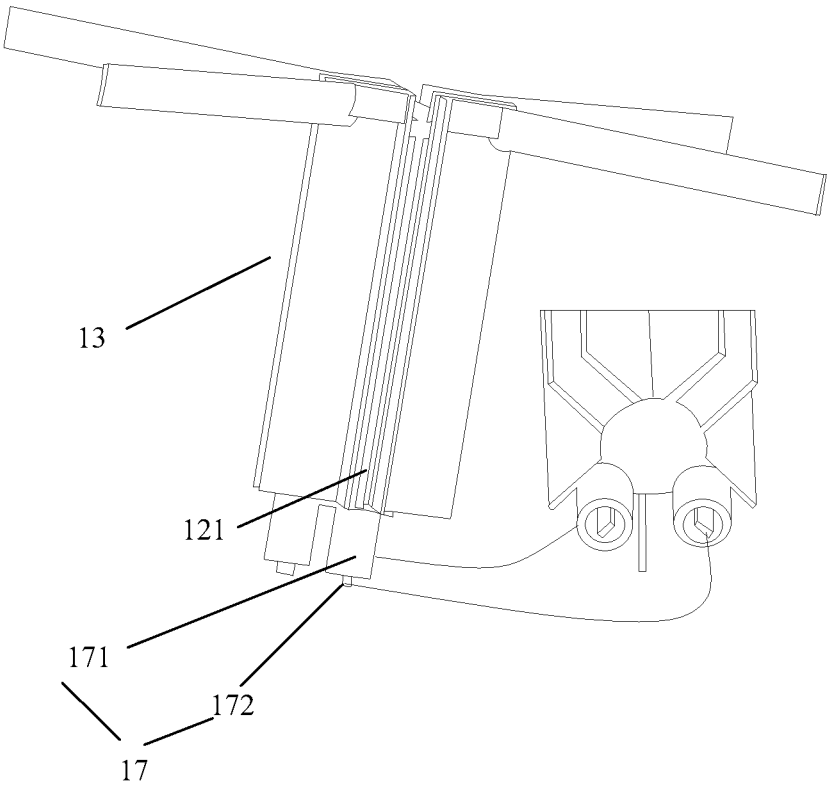
FIG. 7 is a schematic structural diagram of a radiation apparatus according to a fourth embodiment of the present application.

In another embodiment of the present application, as shown in FIG. 7, one end of the first connecting portion 121 of the L-shaped feeding sheet 12 that is away from the second connecting portion 122 forms a coaxial suspended stripline structure 17 together with the balun structure 13, where a metal housing 171 of the coaxial suspended stripline structure 17 is connected to the balun structure 13, and an internal suspended stripline 172 is connected to the end of the first connecting portion 121 of the L-shaped feeding sheet 12 that is away from the second connecting portion 122.

Figure 8:
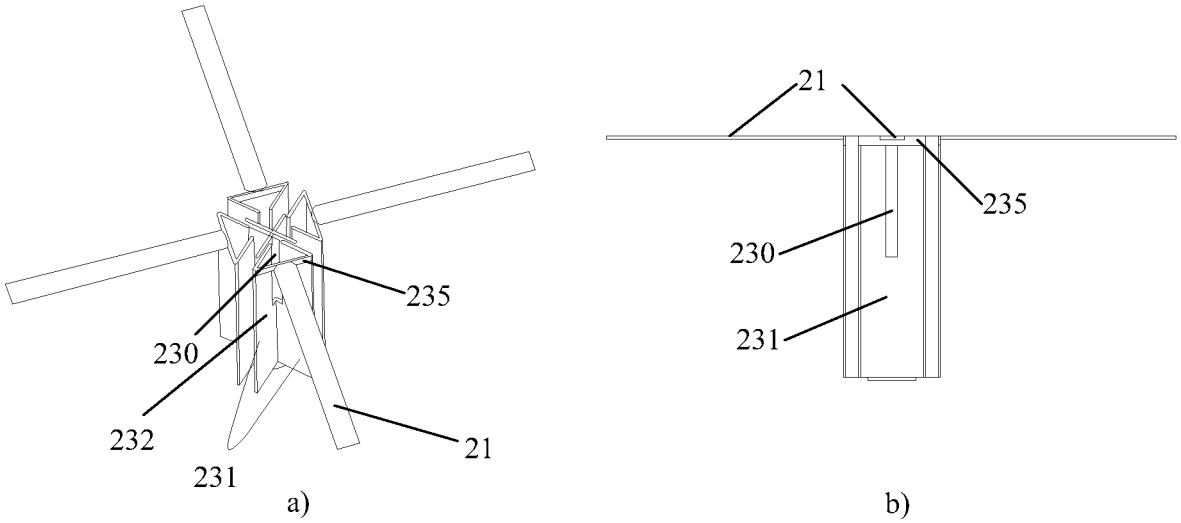
FIG. 8 is a schematic structural diagram of a radiation apparatus according to a fifth embodiment of the present application.
Figure 9:
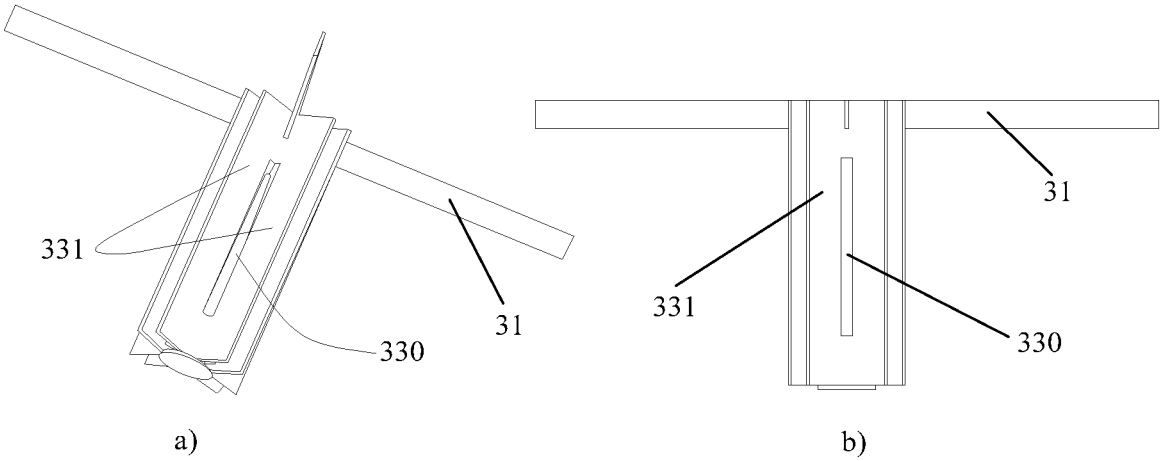
FIG. 9 is a schematic structural diagram of a radiation apparatus according to a sixth embodiment of the present application.

In this embodiment of the present application, two conductive plates that form an L-shaped structure may be integrally connected, or partially connected, or completely separated. As shown in FIG. 8, a diagram a is a solid figure and a diagram b is a side view. In an L-shaped structure 231, connecting sides of two conductive plates 232 are partially connected, and partially form a groove. A groove 230 is formed at one end of the L-shaped structure 231 that is close to a radiator 21. A length direction of the radiator 21 is at 90 degrees to a length direction of a balun structure 23. At one end of each L-shaped structure 231, a transverse rod 235 is connected to two sides of two conductive plates 232 that are away from each other, to form an approximately isosceles triangle, and one end of the radiator 21 is welded to a middle part of the transverse rod 235. A width direction of the radiator 21 is parallel to a length direction of the transverse rod 235. Alternatively, as shown in FIG. 9, a diagram a is a solid figure and a diagram b is a side view. A groove 330 is formed in a middle part of an L-shaped structure 331. A length direction of a radiator 31 is at 90 degrees to a length direction of a balun structure 33.

Figure 10:
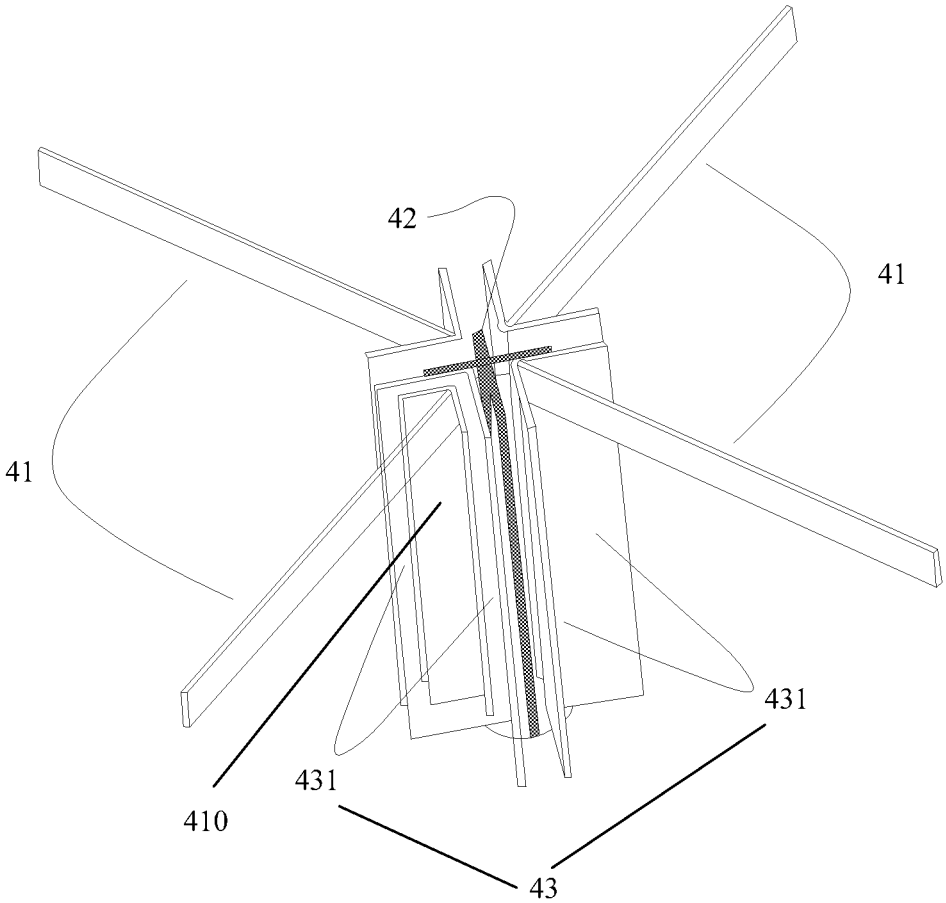
FIG. 10 is a schematic structural diagram of a radiation apparatus according to a seventh embodiment of the present application.

In still another embodiment of the present application, as shown in FIG. 10, an L-shaped structure 43 may be in electrical coupling connection with a radiator 41, but is not in direct electrical connection with the radiator 41. One end of the radiator 41 has a coupling structure 410 that is in electrical coupling connection with the L-shaped structure 43. The coupling structure 410 may be a structure parallel to the L-shaped structure. In another embodiment of the present application, the coupling structure 410 may be a structure not parallel to the L-shaped structure. A coupled area may depend on situations, which is not limited herein.

Figure 11:
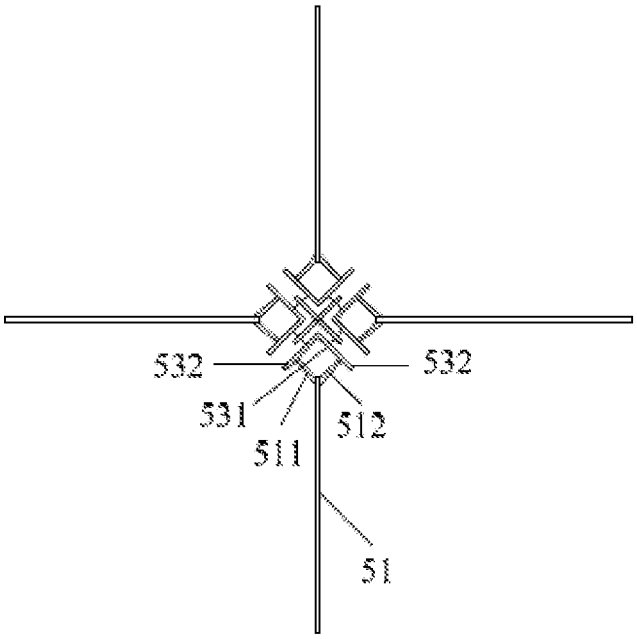
FIG. 11 is a schematic structural diagram of a radiation apparatus according to an eighth embodiment of the present application.

In yet another embodiment of the present application, as shown in FIG. 11, at one end of each L-shaped structure 531, one end of a first connecting rod 511 and one end of a second connecting rod 512 are respectively connected to two conductive plates 532, the other end of the first connecting rod 511 and the other end of the second connecting rod 512 are connected, one end of a radiator 51 is connected to a joint of the first connecting rod 511 and the second connecting rod 512, and connecting sides of the two conductive plates 532 and a length direction of the radiator 51 are in a same plane.

In the foregoing embodiments, connection between a radiator and an L-shaped structure, between the radiator and each connecting rod, between a connecting rod and the radiator, and between the connecting rod and conductive plates may be welding, rivet connection, or screw connection, or another connection manner may be used, which is not limited in the present application.

In conclusion, a radiation apparatus provided in the present application includes at least four radiators, two L-shaped feeding sheets, and a balun structure, where the balun structure consists of four L-shaped structures formed by eight conductive plates; each L-shaped structure is formed by two conductive plates arranged at approximately 90 degrees, each L-shaped structure is electrically connected to one radiator at one end of the balun structure, and angles between a length direction of the radiator and two conductive plates are approximately 45 degrees; every two adjacent L-shaped structures are arranged in a T shape, and the four radiators are approximately in a cross shape and are approximately in a same horizontal plane; two adjacent conductive plates of every two L-shaped structures are approximately parallel to each other and are spaced by a preset distance to form four feeding slots; and the two L-shaped feeding sheets are disposed at approximately 90 degrees in the feeding slots in a staggered manner, and each L-shaped feeding sheet is disposed in two opposite feeding slots, so that when one L-shaped feeding sheet is polarized, the four radiators all participate in radiation. By using vector combination, required working polarization is obtained in a +/−45-degree direction, thereby achieving a +/−45-degree polarization effect, and reducing coupling between a high-frequency unit and a low-frequency unit in a multi-frequency multi-array environment.

The foregoing descriptions are merely embodiments of the present application, and the protection scope of the present application is not limited thereto. All equivalent structure or process changes made according to the content of this specification and accompanying drawings in the present application or by directly or indirectly applying the present application in other related technical fields shall fall within the protection scope of the present application.

What is claimed is:

1. An antenna comprising a radiation apparatus, wherein the radiation apparatus comprises:

at least four radiators;

two feeding sheets; and a balun structure, wherein the balun structure includes four L-shaped structures formed by eight conductive plates;

wherein each L-shaped structure is electrically connected to one radiator at one end of the balun structure, and angles between a length direction of the radiator and two conductive plates are approximately 45 degrees;

wherein each two adjacent L-shaped structures are arranged in a T shape, and the four radiators are in a cross shape and are approximately in a same horizontal plane;

wherein two adjacent conductive plates of each two L-shaped structures are approximately parallel to each other and are spaced by a preset distance to form four feeding slots; and wherein the two feeding sheets are disposed at approximately 90 degrees in the feeding slots in a staggered manner, and each feeding sheet is disposed in two opposite feeding slots.

2. The antenna according to claim 1, wherein a total length of each radiator is approximately one quarter of a wavelength corresponding to an operating frequency band.

3. The antenna according to claim 1, wherein a total length of each conductive plate is approximately one quarter of the wavelength corresponding to the operating frequency band.

4. The antenna according to claim 1, wherein each L-shaped structure is in direct electrical connection or in electrical coupling connection with one radiator.

5. The antenna according to claim 4, wherein one end of the radiator of each L-shaped structure has a coupling structure that is in electrical coupling connection with the L-shaped structure.

6. The antenna according to claim 1, wherein in the L-shaped structure, connecting sides of the two conductive plates are completely connected to form an integral structure.

7. The antenna according to claim 6, wherein the radiator is connected to a joint of the two conductive plates at one end of each L-shaped structure.

8. The antenna according to claim 1, wherein in the L-shaped structure, connecting sides of the two conductive plates are partially connected, and partially form a groove.

9. The antenna according to claim 8, wherein the groove is formed at one end of the L-shaped structure that is close to the radiator.

10. The antenna according to claim 8, wherein the groove is formed in a middle part of the L-shaped structure.

11. The antenna according to claim 1, wherein a length direction of the radiator is at 90 degrees or slightly tilted with respect to a length direction of the balun structure.

12. The antenna according to claim 1, wherein at one end of each L-shaped structure, a transverse rod is connected to two sides of the two conductive plates that are away from each other to form an approximately isosceles triangle, and one end of the radiator is welded to a middle part of the transverse rod.

13. The antenna according to claim 1, wherein at one end of each L-shaped structure, one end of a first connecting rod and one end of a second connecting rod are respectively connected to the two conductive plates, the other end of the first connecting rod and the other end of the second connecting rod are connected to each other, one end of the radiator is connected to a joint of the first connecting rod and the second connecting rod, and connecting sides of the two conductive plates and the length direction of the radiator are in a same plane.

14. The antenna according to claim 1, wherein the feeding sheet comprises a first connecting portion, a second connecting portion, and a third connecting portion, wherein the third connecting portion is parallel to the first connecting portion and has a length less than that of the first connecting portion, the second connecting portion is perpendicularly connected to the first connecting portion and the third connecting portion, and the first connecting portion and the third connecting portion are respectively disposed in two opposite feeding slots.

15. The antenna according to claim 14, wherein one end of the first connecting portion of the feeding sheet that is away from the second connecting portion is directly inserted into a PCB, and the conductive plate is connected to a ground of the PCB.

16. The antenna according to claim 15, wherein the end of the first connecting portion of the feeding sheet that is away from the second connecting portion forms a coaxial suspended stripline structure together with the balun structure, wherein a metal housing of the coaxial suspended stripline structure is connected to the balun structure, and an internal suspended stripline is connected to the end of the first connecting portion of the feeding sheet that is away from the second connecting portion.

17. The antenna according to claim 1, wherein each L-shaped structure is formed by two conductive plates arranged at approximately 90 degrees.

18. A communications system comprising an antenna, wherein the antenna comprises a radiation apparatus, the radiation apparatus comprising:

at least four radiators;

two feeding sheets; and a balun structure, wherein the balun structure includes four L-shaped structures formed by eight conductive plates;

wherein each L-shaped structure is electrically connected to one radiator at one end of the balun structure, and angles between a length direction of the radiator and two conductive plates are approximately 45 degrees;

wherein each two adjacent L-shaped structures are arranged in a T shape, and the four radiators are in a cross shape and are approximately in a same horizontal plane;

wherein two adjacent conductive plates of each two L-shaped structures are approximately parallel to each other and are spaced by a preset distance to form four feeding slots; and wherein the two feeding sheets are disposed at approximately 90 degrees in the feeding slots in a staggered manner, and each feeding sheet is disposed in two opposite feeding slots.

19. The communications system according to claim 18, wherein the feeding sheet comprises a first connecting portion, a second connecting portion, and a third connecting portion, wherein the third connecting portion is parallel to the first connecting portion and has a length less than that of the first connecting portion, the second connecting portion is perpendicularly connected to the first connecting portion and the third connecting portion, and the first connecting portion and the third connecting portion are respectively disposed in two opposite feeding slots.

20. The communications system according to claim 19, wherein the end of the first connecting portion of the feeding sheet that is away from the second connecting portion forms a coaxial suspended stripline structure together with the balun structure, wherein a metal housing of the coaxial suspended stripline structure is connected to the balun structure, and an internal suspended stripline is connected to the end of the first connecting portion of the feeding sheet that is away from the second connecting portion.

* * * * *